United States Patent [19]

Rudert

[11] 4,059,080

[45] Nov. 22, 1977

[54] ENGINE COMPARTMENT VENTILATING ARRANGEMENT

[75] Inventor: Wolfgang Rudert, Langenargen, Germany

[73] Assignee: Motoren- und Turbinen-Union Friedrichshafen GmbH, Germany

[21] Appl. No.: 651,910

[22] Filed: Jan. 23, 1976

[30] Foreign Application Priority Data

Jan. 23, 1975 Germany ..... 2502633

[51] Int. Cl.[2] ..... F01P 11/08

[52] U.S. Cl. ..... 123/41.33; 60/599; 123/41.49; 123/41.51; 123/41.57

[58] Field of Search ..... 123/119 CD, 41.31, 41.33, 123/41.49, 41.51, 41.57, 41.62, 41.66, 196 AB; 165/51; 60/599

[56] References Cited

U.S. PATENT DOCUMENTS

| | | | |
|---|---|---|---|
| 1,904,407 | 4/1933 | Cappa | 123/41.33 |
| 2,171,817 | 9/1939 | Wagner | 123/41.31 |
| 2,268,884 | 1/1942 | Linn | 123/41.31 |
| 2,321,097 | 6/1943 | Mills | 123/41.31 |
| 2,918,787 | 12/1959 | Schelp | 60/599 |
| 3,029,594 | 4/1962 | Miller | 60/599 |
| 3,134,371 | 5/1964 | Crooks | 123/41.31 |
| 3,203,499 | 8/1965 | Bentz | 123/41.31 |
| 3,728,856 | 4/1973 | Scherenberg | 60/599 |
| 3,921,603 | 11/1975 | Bentz | 123/41.33 |
| 3,976,041 | 8/1976 | Mettig | 123/41.31 |

*Primary Examiner*—Ronald H. Lazarus
*Assistant Examiner*—Daniel J. O'Connor
*Attorney, Agent, or Firm*—Craig & Antonelli

[57] ABSTRACT

A ventilating arrangement for a compartment of an internal combustion engine which arrangement includes an air guiding housing separated from the engine compartment by a wall with a finned annular cooling arrangement being disposed in the housing for drawing-in ambient cooling air and directing at least a portion of the drawn-in-air into the engine compartment. The wall separating the air guiding housing from the engine compartment is provided with an air discharge opening with the annular cooler being provided with a thinless sector adjacent the air discharge opening. A charging air cooler arrangement is disposed adjacent the air discharge opening with an oil cooler arrangement being disposed on a downstream side of the charging air cooler. A fuel cooler arrangement may be interposed between the air discharge opening and the charging air cooler to cool the fuel supplied to the internal combustion engine.

10 Claims, 2 Drawing Figures

ENGINE COMPARTMENT VENTILATING ARRANGEMENT

The present invention relates to a ventilating arrangement and more particularly to a ventilating arrangement for an engine compartment of a liquid cooled, supercharged internal combustion engine whereby the cooling fluid for ventilating of the internal combustion engine compartment is return-flow cooled in a cooler by means of surrounding or ambient air.

Ventilating arrangements are known wherein a part of the air quantity for the ventilation of the engine compartment is taken from the cooling air, brought to a high pressure level by a cooling blower and then reduced to a low pressure sufficient for the ventilation of the engine compartment. This conventional construction is disadvantageous since, on the one hand, the energy which must be produced by the cooling blower for applying a part of the volume of cooling air to a high pressure level is lost and, on the other hand, a cooling blower having a large blower output is required resulting in unnecessary operating and manufacturing costs.

It is an aim of the present invention to provide a ventilating arrangement for an engine compartment of an internal combustion engine which avoids the aforementioned shortcomings encountered in the prior art.

The underlying problems are solved according to the present invention by arranging a cooler blower in an air guiding housing separated from the engine compartment by a wall with the engine compartment being maintained at a slight overpressure or superatmospheric pressure by a part of the volume of the cooling air delivered by the cooler blower. By virtue of this arrangement dust or the like is prevented from entering the engine compartment and a portion of the heat radiated from the operating internal combustion engine into the engine compartment is carried away.

According to one feature of the present invention, a finned ring or annular cooler blower is provided with one section of the block or housing of the cooler blower being free of cooler fins which sector directly joins an opening provided in a wall of the air guiding housing in which the ring cooler blower is disposed and with a charging air cooler arranged directly at the opening, preferably, at the outside of the air guiding housing through which charging air cooler is swept at least a portion of the volume of cooling air for the engine compartment.

According to a further advantageous feature of the present invention, an oil cooler arrangement is disposed directly adjacent the charging air cooler on a downstream side thereof with respect to the air cooler blower with at least a portion of the volume of the cooling air for the engine compartment also being directed through the oil cooler arrangement.

According to yet another advantageous feature of the present invention in situations wherein the cooling of fuel is necessary, a fuel cooler arrangement is interposed between the charging air cooler and the cooling blower in such a manner that the fuel cooler and charging air cooler are in series whereby at least a portion of the volume of the cooling air from the cooling blower is first directed through the fuel cooler and then through the charging air cooler and, if provided, through the oil cooler.

One advantage of the ventilating arrangement in accordance with the present invention resides in the fact that by air cooling the charging air a lower charging air cooling temperature is possible than by cooling the charging air by the cooling fluid of the internal combustion engine since the cooling air temperature from the cooling blower is always lower than the lowest or coolest temperature of the cooling fluid of the internal combustion engine.

Furthermore, by virtue of the arrangement of the present invention for ventilating the engine compartment, a large quantity of cooling air is available since, with a constant output of the cooling blower, the cooling air requirement of the ring or annular cooler blower is decreased by the amount of charging air heat otherwise carried away by the cooling fluid of the internal combustion engine.

Additionally, another advantage of the present invention resides in the fact that the required pressure decrease of the portion of the volume of cooling air for the engine compartment has profitable results in the arranging of the charging air cooler and/or the fuel cooler and/or the oil cooler between the ring cooler and the engine compartment.

Also, by virtue of the disposition of the oil cooler arrangement downstream of the charging air cooler in accordance with the present invention, during the starting of the internal combustion engine a quick heating of the lubricating oil in the oil cooler arrangement is obtained by a portion of the volume of the cooling air heated by the charging air cooler when the volume of air is swept therethrough.

Accordingly, it is an object of the present invention to provide a ventilating arrangement for a compartment of an internal combustion engine which avoids by simple means the aforementioned shortcomings and drawbacks encountered in the prior art.

A further object of the present invention resides in providing a ventilating arrangement for an engine compartment which results in an improved utilization of the cooler blower output for a part volume of branched-off cooling air.

These and other objects, features, and advantages of the present invention will become more apparent from the following description when taken in connection with the accompanying drawing which shows, for the purposes of illustration only, one embodiment in accordance with the present invention, and wherein.

Figure 1:
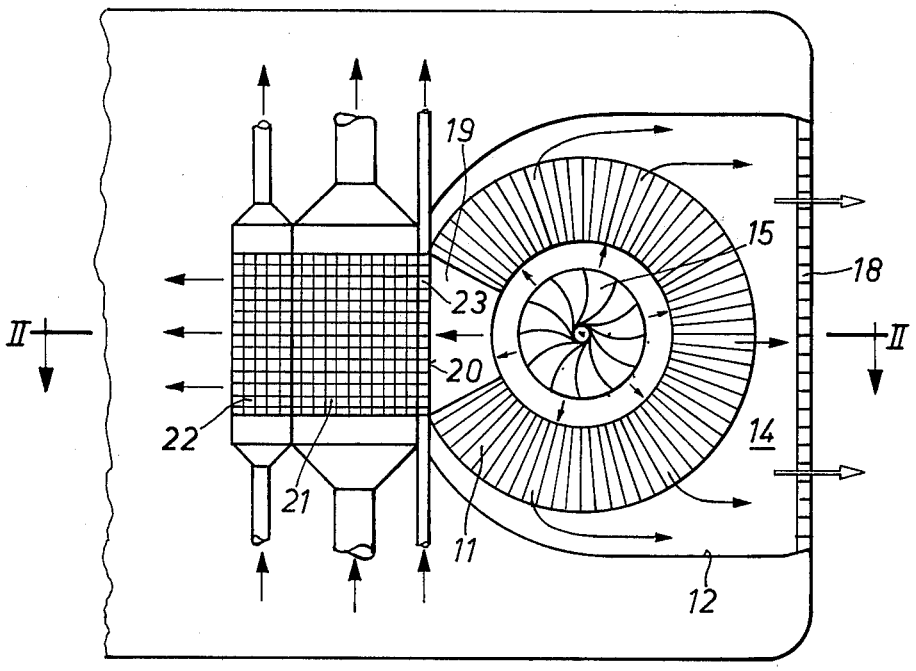
FIG. 1 is a plan view of a ventilating arrangement in accordance with the present invention taken along the line I—I of FIG. 2.

Referring now to the drawings wherein like reference numerals are used in both views to designate like parts, and more particularly to FIG. 1, according to this Figure, an annular or ring-shaped cooler 11 having a plurality of cooling fins is arranged in an air guiding housing 14 separated by a wall 12 from an engine compartment 13 housing an internal combustion engine (not shown).

Figure 2:
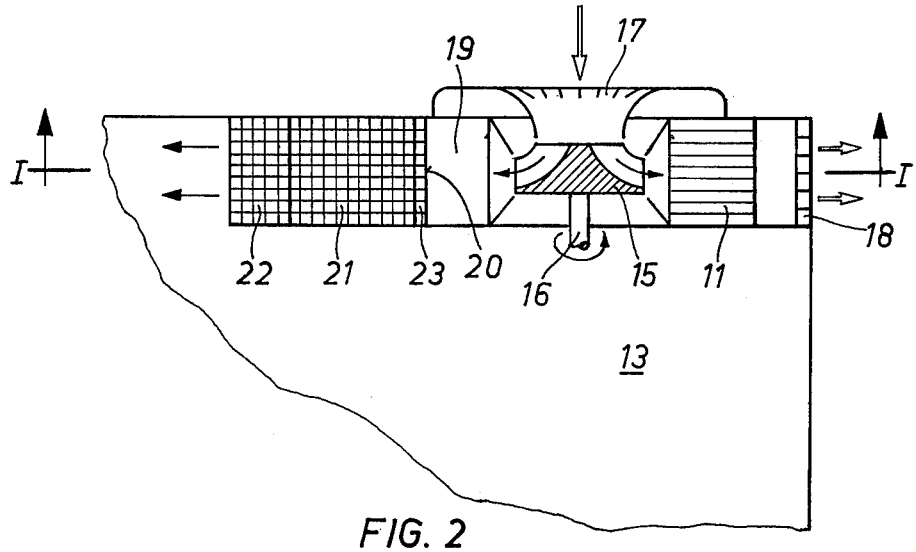
FIG. 2 is a view of the ventilating arrangement according to the present invention taken along the line II—II of FIG. 1.

As shown in FIGS. 1 and 2, an air opening or aperture 20 is provided in the wall 12 of the air guiding housing 14 at a position directly adjoining a finnless sector 19 of the ring cooler 11. An air impeller mounted on a drive shaft 16 is driven by a suitable drive mechanism (not shown) whereby air from the surroundings is drawn through an air inlet 17 by the rotating impeller 15. As indicated by the air flow arrows in FIGS. 1 and 2, a compressed cooling air from the air inlet 17 flows radially through the fins of a ring cooler 11 with a portion of the drawn-in volume of cooling air being discharged to the atmosphere through a discharge opening 18 formed in the air guiding housing 14.

The remaining portion of the drawn-in cooling air is directed through sector 19 and opening 20 to the engine compartment 13. In order to throttle the compressed cooling air arriving at the opening 20 profitably to a lower pressure required for the engine compartment ventilation, a charging air cooler 21 is arranged directly adjacent the opening and, preferably, outside the air guiding housing 14 which is passed through by the volume of cooling air for the engine compartment 13.

An oil cooler 22 is disposed immediately adjacent the charging air cooler 21 and may be connected directly thereto with the volume of compressed cooling air from the opening 20 passing through the charging air cooler 21, oil cooler 22 and then into the engine compartment 13. By virtue of the disposition of the oil cooler 22 on the downstream side of the charging air cooler 21 a quick heating of the lubricating oil in the oil cooler 22 is realized by virtue of the heat acquired by the compressed cooling air as such air passes through the charging air cooler 21.

In certain situations, it may be desirable and necessary to cool the fuel supplied to the internal combustion engine and, in accordance with the present invention, a fuel cooler 23 may be preferably arranged in series with the charging air cooler 21 and oil cooler 22. If desired, the fuel cooler may be directly attached on the upstream side of the charging air cooler 21. Preferably, the fuel cooler 23 is interposed between the air opening 20 and the charging air cooler 21 in the cooling air stream so that the volume of compressed cooling air leaving the opening 21 first flows through the fuel cooler 23 and then to the charging cooler 21 and subsequently to the oil cooler 22.

While I have shown and described only one embodiment in accordance with the present invention, it is understood that the same is not limited thereto but is susceptible of numerous changes and modifications as known to a person skilled in the art, and I therefore do not wish to be limited to the details shown and described herein but do intend to cover all such changes and modifications as are encompassed by the scope of the appended claims.

I claim:

1. A ventilating arrangement for an engine compartment of a liquid-cooled, supercharged internal combustion engine, the cooling fluid of the internal combustion engine being cooled in a return flow by ambient air, the arrangement comprising: an air guiding housing means having a wall separating said housing means from the engine compartment, means provided in said wall for communicating said air guiding housing means with the engine compartment, a blower means for supplying a predetermined volume of cooling air from said air guiding housing means through said communicating means to the engine compartment to maintain a slight over pressure in the engine compartment, said blower means includes an air impeller means, and a plurality of spaced cooling fins annularly disposed about said air impeller means, said cooling fins being arranged at said communicating means such that a sector shaped area free of any cooling fins is defined at the communicating means whereby said predetermined volume of cooling air from said impeller means flows directly from said impeller means to said communicating means, and wherein a charging air cooler means is arranged directly at said communicating means whereby said predetermined volume of cooling air from said impeller means flows from said air guiding housing means through said communicating means and said air charging cooler means to the engine compartment.

2. An arrangement according to claim 1, further comprising an oil cooler means arranged on a downstream side of said charging air cooler means such that said predetermined volume of cooling air from said impeller means flows from said communicating means through said charging air cooler means and said oil cooler means into the engine compartment.

3. An arrangement according to claim 1, further comprising a fuel cooler means interposed between said communicating means and said charging air cooler means whereby said predetermined volume of cooling air from said impeller means flows from said communicating means through said fuel cooler means and charging air cooler means into the engine compartment.

4. An arrangement according to claim 3, wherein said predetermined volume of cooling air is less than the volume of cooling air supplied by said blower means, and wherein means are provided in said air guiding housing means for discharging the volume of cooling air in excess of said predetermined volume into an area surrounding the engine compartment.

5. An arrangement according to claim 2, further comprising a fuel cooler means interposed between said communicating means and said charging air cooler means whereby said predetermined volume of cooling air from said impeller means flows from said communicating means through said fuel cooler means, said charging air cooler means, and said oil cooler means into the engine compartment.

6. An arrangement according to claim 5, wherein said predetermined volume of cooling air is less than the volume of cooling air supplied by said blower means, and wherein means are provided in said air guiding housing means for discharging the volume of cooling air in excess of said predetermined volume into an area surrounding the engine compartment.

7. An arrangement according to claim 1, wherein said predetermined volume of cooling air is less than the volume of cooling air supplied by said blower means, and wherein means are provided in said air guiding housing means for discharging the volume of cooling air in excess of said predetermined volume into an area surrounding the engine compartment.

8. A ventilating arrangement for an engine compartment of a liquid-cooled, supercharged internal combustion engine, the cooling fluid of the internal combustion engine being cooled in a return flow by ambient air, the arrangement comprising: an air guiding housing means having a wall separating said housing means from the engine compartment, means provided in said wall for communicating said air guiding housing means with the engine compartment, a blower means for supplying a predetermined volume of cooling air from said air guiding housing means through said communicating means to the engine compartment to maintain a slight over pressure in the engine compartment, a charging air cooler means arranged directly at said communicating means, and an oil cooler means arranged on a downstream side of said charging air cooler means such that said predetermined volume of cooling air from said blower means flows from said communicating means through said charging air cooler means and said oil cooler means into the engine compartment.

9. An arrangement according to claim 8, further comprising a fuel cooler means interposed between said communicating means and said charging air cooler means whereby said predetermined volume of cooling air from said blower means flows from said communicating means through said fuel cooler means, said charging air cooler means, and said oil cooler means into the engine compartment.

10. An arrangement according to claim 9, wherein said predetermined volume of cooling air is less than the volume of cooling air supplied by said blower means, and wherein means are provided in said air guiding housing means for discharging the volume of cooling air in excess of said predetermined volume into an area surrounding the engine compartment.

* * * * *